US007789695B2

(12) United States Patent
Radle

(10) Patent No.: US 7,789,695 B2
(45) Date of Patent: Sep. 7, 2010

(54) INSULATION DISPLACEMENT CONNECTOR

(75) Inventor: Patrick J. Radle, Mequon, WI (US)

(73) Assignee: Actuant Corporation, Butler, WI (US)

( * ) Notice: Subject to any disclaimer, the term of this patent is extended or adjusted under 35 U.S.C. 154(b) by 108 days.

(21) Appl. No.: 12/135,653

(22) Filed: Jun. 9, 2008

(65) Prior Publication Data

US 2008/0305675 A1 Dec. 11, 2008

Related U.S. Application Data

(60) Provisional application No. 60/933,643, filed on Jun. 7, 2007, provisional application No. 61/128,742, filed on May 23, 2008.

(51) Int. Cl.
*H01R 4/24* (2006.01)

(52) U.S. Cl. ..... 439/402; 439/403; 439/409

(58) Field of Classification Search ..... 439/402, 439/409, 410, 417, 404, 276, 441, 519, 936, 439/521, 787, 135, 148; 81/16; 279/149
See application file for complete search history.

(56) References Cited

U.S. PATENT DOCUMENTS 2,609,415 A 9/1952 Benander et al.
2,627,537 A 2/1953 Weisberg
3,388,370 A * 6/1968 Elm ..... 439/402
3,793,611 A * 2/1974 Johansson et al. ..... 439/399
3,793,612 A * 2/1974 Driscoll ..... 439/402
3,858,157 A * 12/1974 Bazille, Jr. ..... 439/400
3,877,774 A 4/1975 Dorrell
4,037,905 A * 7/1977 Lucas ..... 439/402
4,793,823 A 12/1988 Cozzens et al.
4,995,829 A 2/1991 Geib et al.
5,080,606 A * 1/1992 Burkard ..... 439/403
5,961,341 A * 10/1999 Knowles et al. ..... 439/403
6,468,103 B1 * 10/2002 Brower ..... 439/417
6,500,020 B2 12/2002 Vo et al.

* cited by examiner

*Primary Examiner*—Michael C Zarroli
(74) *Attorney, Agent, or Firm*—Quarles & Brady LLP

(57) ABSTRACT

The present invention provides an insulation displacement connector that is suitable for the tool-less connection of wires of various gages. The combination of channels having a reduction in effective diameter and blades having various gaps restricts the insertion of the wires such that an appropriately-sized pair of blades can pierce the insulation to contact the metallic core of each wire. Because of this configuration, the wire connector does not require excessive force to bite down on the wires. Because a large force is not required, the insulation displacement connector can be finger operated and no separate tool is necessary.

19 Claims, 12 Drawing Sheets

INSULATION DISPLACEMENT CONNECTOR

CROSS-REFERENCE TO RELATED APPLICATION

This application claims the benefit of U.S. provisional patent application 60/933,643 filed on Jun. 7, 2007 and U.S. provisional patent application 61/128,742 filed on May 23, 2008. The contents of these patent applications are hereby incorporated by reference in their entirety.

STATEMENT REGARDING FEDERALLY SPONSORED RESEARCH OR DEVELOPMENT

Not applicable.

FIELD OF THE INVENTION

This invention relates to wire connectors. In particular, this invention relates to a wire connector in which blades pierce the insulation of wires to establish an electrical connection.

BACKGROUND OF THE INVENTION

Typically, wires have a metallic core surrounded by an insulating coating. When a current is run through the metallic core of the wire, the insulating coating assures that the current is contained within the insulation and does not deviate outside of the wire due to a short. When performing electrical work, it may be necessary to join wires at a connection such that a current may safely travel from one wire to another. Forming a connection between wires may be done in a number of ways.

One method of connecting wires is to have a conductive blade or blades clamp down on the wire to pierce the insulating coating surrounding the wire. If the blade pierces the insulating coating such that the conductive blade contacts the metallic core, then an electrical connection may be formed between the conductive blade and the metallic core that the blade contacts. Such connections are common in attaching plugs to data cables or audio-video cables.

However, forming such connections commonly require that a crimping tool be used to force the blade into the wire insulation. Furthermore, the connectors and tools are typically adapted for forming a specific connection (i.e., inserting wires of a certain gage into a specific type of connector for a particular application).

Hence, there is a need for an improved means for connection of wires given the varied nature of electrical work and the wires to be connected.

SUMMARY OF THE INVENTION

The present invention provides an insulation displacement connector for the easy connection of a set of wires, including wires of different gages.

According to one form of the invention, an insulation displacement connector includes a housing, a metal insert, and a handle. The housing defines at least one channel for receiving at least one wire from at least one point of wire insertion. The housing further defines a track that intersects at least one channel. The metal insert has a body portion with at least one blade extending therefrom. The metal insert is located in and slideably moveable within the track such that a portion of the at least one blade can move into and out of at least one channel of the housing. The handle has a cam portion and is rotatable relative to the housing about an axis that runs through the cam portion of the handle. The cam portion selectively contacts the body portion of the metal insert as the handle is rotated about the axis. The insulation displacement connector has an open position in which at least one wire can be received by at least one channel and a closed position in which the cam portion of the handle forces at least one blade of the metal insert into at least one channel to pierce the insulation of any wire contained therein.

According to another form of the invention, the insulation displacement connector includes a plurality of channels and a metal insert slideably moveable in a track. The plurality of channels are for receiving a plurality of wires along a direction of wire insertion. Accordingly, each of the channels extend from a corresponding opening for insertion of one of the wires. The metal insert is slideably moveable in a track and has a first row of blades and second row of blades that selectively intersect the channels. The first row and the second row of blades each have a plurality of pairs of blades. There is a gap between the blades of each pair. The gap between the blades of each pair of blades in the first row is greater than the gap between the blades of each pair of blades in the second row. The pairs of blades of the first row of blades can intersect the corresponding channels at an intersection proximal the corresponding opening of each of the channels, while the pairs of blades of the second row of blades intersect corresponding channels at an intersection distal the corresponding opening of each of the channels. In both the first and second row of blades, the gap between the pairs of blades extends laterally across the corresponding channel relative to the direction of wire insertion. Further, each of the channels reduce in effective diameter between the first row of blades and the second row of blades. Thus, if a relatively larger diameter wire is inserted into the channels, then the channels restrict the insertion depth of the relatively larger diameter wire so that it does not reach the second row of blades. However, the channels permit a relatively smaller diameter wire to be inserted such that it can reach the second row of blades. When the metal insert is forced into the channels, so as to pierce an insulation covering of each of the wires, electrical contact is made between the first row of blades and the relatively larger diameter wires and electrical contact is made between the second row of blades and the relatively smaller diameter wires.

These and still other advantages of the invention will be apparent from the detailed description and drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figure 1:
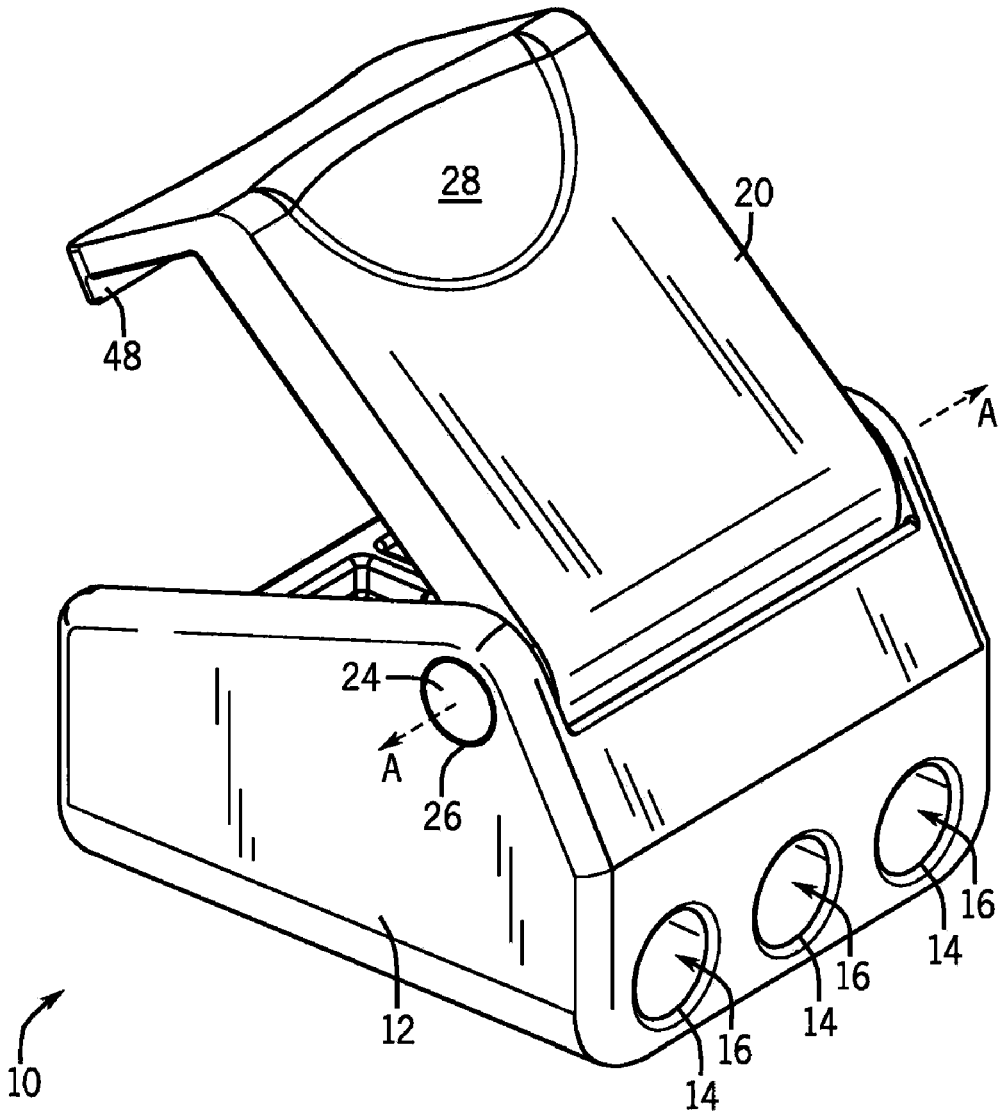
FIG. 1 is a perspective view of an insulation displacement connector in an open position.
Figure 2:
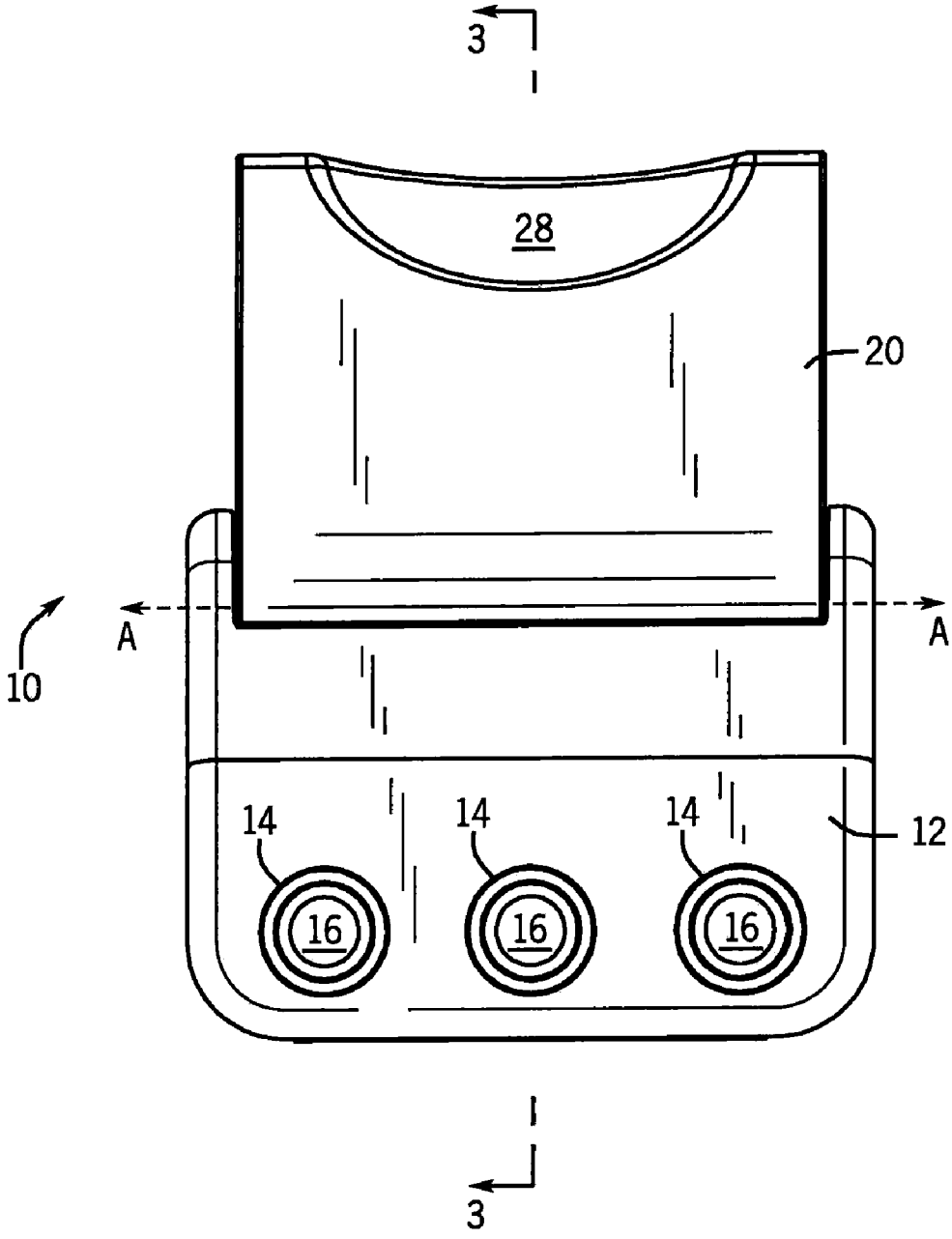
FIG. 2 is a front plan view of the insulation displacement connector of FIG. 1.
Figure 3:
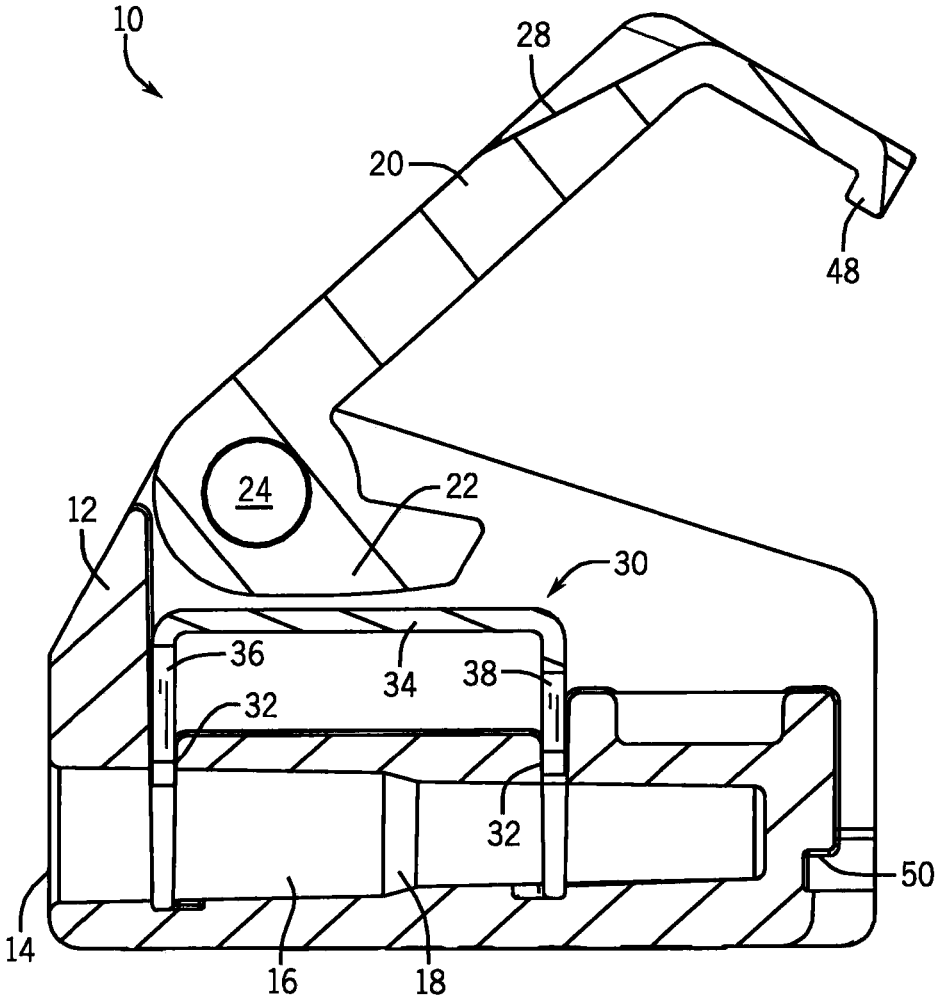
FIG. 3 is a cross-sectional side view of the insulation displacement connector along a line 3-3 of FIG. 2.

Referring first to FIGS. 1-3, an insulation displacement connector 10 is shown in the open position. The insulation displacement connector 10 has a housing 12 with a plurality of openings 14 for receiving a plurality of wires. While the plurality of channels 16 includes three channels, the insulation displacement connector 10 may have two, three, four, or more channels for receiving wires.

The plurality of openings 14 extend into the housing 12 as a plurality of channels 16, which taper inward as they extend away from the plurality of openings 14. Although the inward taper may be gradual over the distance of each of the plurality of channels 16, the plurality of channels 16 may include a step 18 on a portion of the taper. The step 18 provides a portion of the channel having a steeper rate of taper towards the axis of the channel than the rate of taper for the rest of the channel.

It should appreciated that although the plurality of channels 16 have been described as tapered, that the plurality of channels 16 do not need to be round in cross section or tapered. Rather, the plurality of channels 16 have an effective diameter that reduces as the plurality of channels 16 extend away from the plurality of openings 14 along a direction of wire insertion between the first row of blades 36 and the second row of blades 38, as will be described below. The effective diameter, as used herein, is used to describe the largest diameter circle that could be circumscribed in a cross section of the channel perpendicular to the direction of wire insertion at each of the various points along the channel. Thus, the plurality of channels 16 can have "effective diameters" even while taking on a cross sectional shape resembling a square, triangular, rectangle, oval, and the like. Moreover, rather than tapering, the plurality of channels 16 may incorporate stepped segments or the like.

A handle 20 with a cam portion 22 is rotatably attached to the housing 12. As shown, a shaft 24 extends through the cam portion 22 of the handle 20 and into apertures 26 in the housing 12, such that the handle 20 pivots about an axis of rotation A-A that runs through the cam portion 22. The shaft 24 could be integrally formed as a part of the handle 20 or formed separately from the handle 20.

The handle 20 may also include a groove 28. The groove 28 may be shaped for matching engagement with a finger or thumb when the handle 20 is being depressed.

As can be seen most clearly in FIG. 3, a metal insert 30 is located in a track 32 formed in the housing 12. The track 32 includes a forward guide portion proximal the plurality of openings 14 for guiding the first row of blades 36 and a rear guide portion distal the plurality of openings 14 for guiding the second row of blades 38, as will be described below. A bridge portion of the housing extends between the forward guide portion and the rear guide portion. It should be noted that portions of the track 32 can extend into or across the plurality of channels 16.

Figure 4:
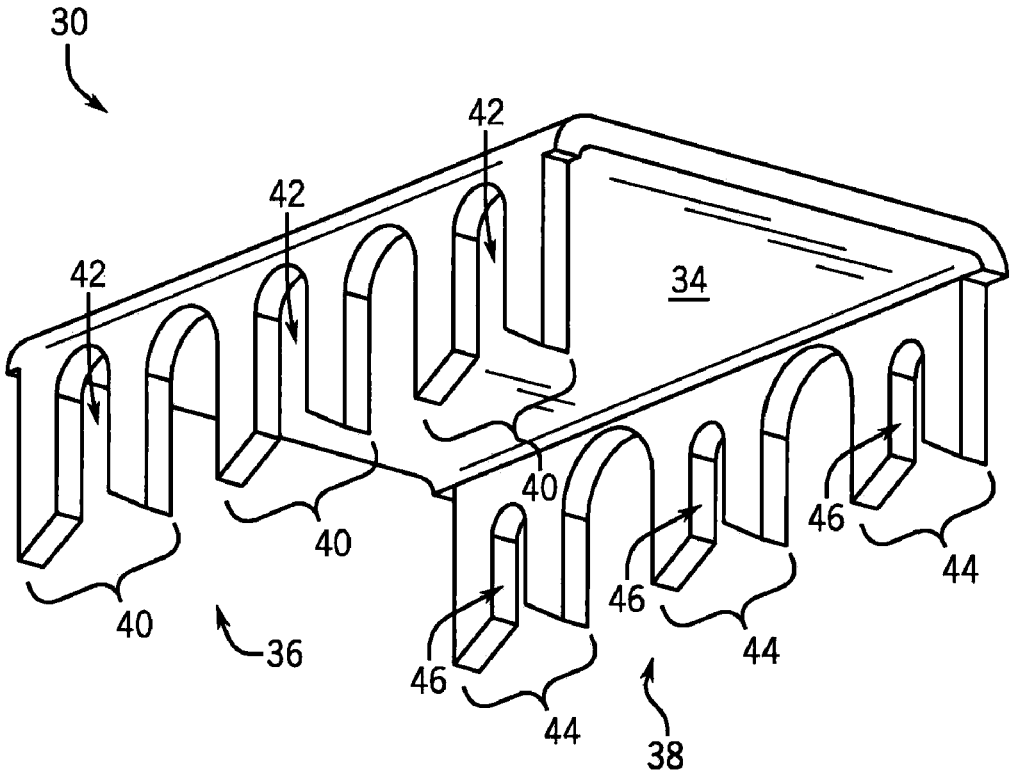
FIG. 4 is a perspective view of the metal insert.

Referring now to FIG. 4, the metal insert 30 can be seen separate from the housing 12 to better show the structure of the metal insert 30. The metal insert 30 is generally U-shaped and may be formed by a process such as stamping. The metal insert 30 has a body 34 that is generally flat planar with a first row of blades 36 and a second row of blades 38 extending orthogonally from opposing sides of the body 34. The first row of blades 36 has a plurality of pairs of blades 40 each having a gap 42 therebetween. Likewise, the second row of blades 38 has a plurality of pairs of blades 44 each having a gap 46 therebetween. In each of the first row of blades 36 and the second row of blades 38, each pair of the plurality of pairs of blades 40 and 44 correspond to one of the plurality of channels 16. Notably, the gap 42 between each of the plurality of pairs of blades 40 in the first row of blades 36 is greater than the gap 46 between each of the plurality of pairs of blades 44 in the second row of blades 38.

In one form, the gap 42 between each of the plurality of pairs of blades 40 in the first row of blades 36 is approximately 0.055 inches while the gap 46 between each of the plurality of pairs of blades 44 in the second row of blades 38 is approximately 0.03 inches. These values correspond to appropriate gaps for straddling and contacting the metallic core of particular gages of wire as will be described in more detail below. However, the particular values of the gaps may be changed to accommodate different gage wires.

Figure 14:
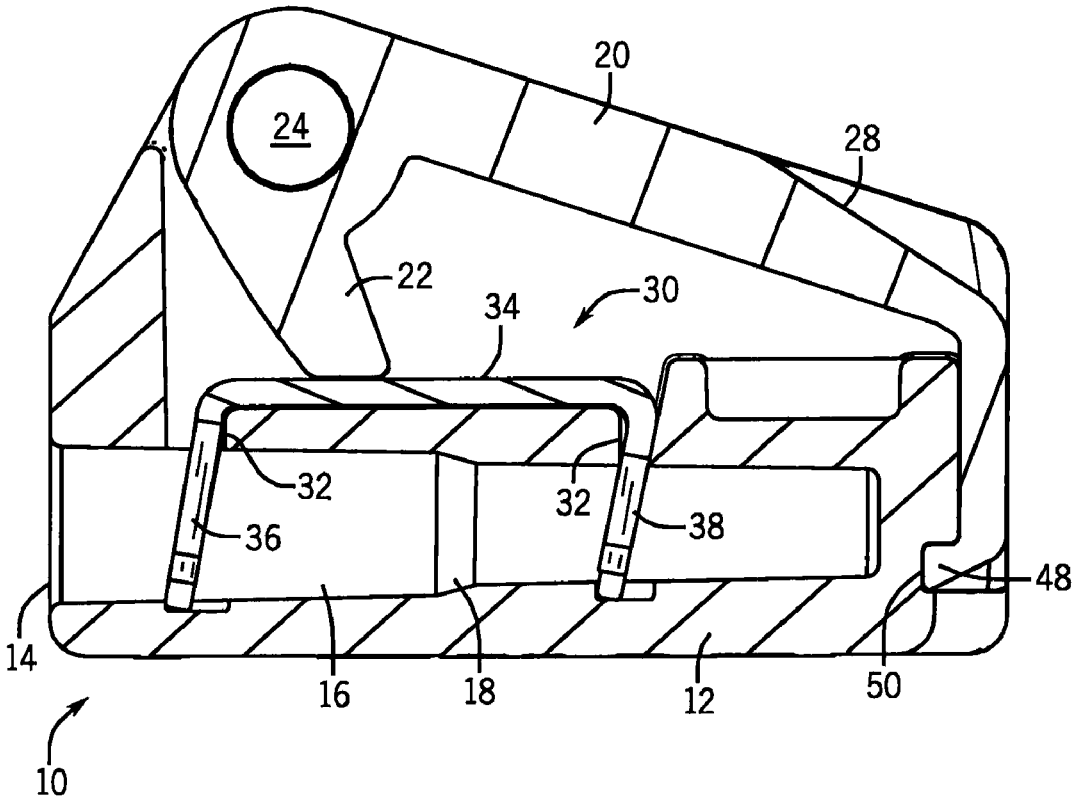
FIG. 14 is a cross-sectional side view of an insulation displacement connector having a track oriented at an acute angle relative to a direction of wire insertion.

Further, and referring to FIG. 14, it should be appreciated that the track 32 and the metal insert 30 may be formed such that the blades of the metal insert 30 will intersect the plurality of channels 16 at an acute angle relative to the direction of the wire insertion. One benefit of an angular intersection is although the metal insert 30 may initially block the plurality of channels 16 before the wire is inserted, the wires may force the metal insert 30 out of the plurality of channels 16 when the wires non-orthogonally contact the flat surface of the blades. Yet another benefit of the angular intersection is that, when the blades of the metal insert 30 pierce the insulation of the wires, attempting to pull the wires out of the plurality of channels 16 will only further force in the blades of the metal insert 30 into the wires.

Referring back to FIGS. 1-4, the track 32 intersects each of the plurality of channels 16. The metal insert 30 is slideably moveable within the track 32 such that at least a portion of the first row of blades 36 and the second row of blades 38 can move into and out of the plurality of channels 16. More specifically, the forward guide portion of the track 32 directs the first row of blades 36 into the plurality of channels 16 and the rear guide portion of the track 32 directs the second row of blades 38 into the plurality of channels 16. For each channel in the plurality of channels 16, there is a corresponding set of pairs of blades from the first row of blades 36 and from the second row of blades 38, guided by the forward guide portion and rear guide portion of the track 32 respectively, that can move into and out of that channel. Importantly, the first row of blades 36 move into and out of the plurality of channels 16 at a point of intersection with the track 32 closer to the plurality of openings 14 than the second row of blades 38. When the blades of the metal insert 30 are not located in the plurality of channels 16, then the plurality of channels 16 are clear such that wires can be received therein as illustrated in FIG. 2.

As shown in FIGS. 1-4, the insulation displacement connector 10 is in an open position. In this position, the cam portion 22 of the handle 20 is oriented such that the blades of the metal insert 30 are not forced into the plurality of channels 16. When the handle 20 is in the open position, the metal insert 30 in the housing 12 is permitted to slide to a portion of the track 32 at which the edges of the blades of the metal insert 30 are not in the plurality of channels 16 such that wires can be received in the plurality of channels 16.

It should be noted that the metal insert 30 can be retained in the up position with the channels clear by frictional force between the track 32 and the metal insert 30. However, other biasing mechanisms such as, for example, a spring, magnets, or the like may be used to maintain the up position of the metal insert 30 in the open position. Additionally, the metal insert 30 and track 32 may be formed such that they loosely fit together with an interference fit.

Figure 5:
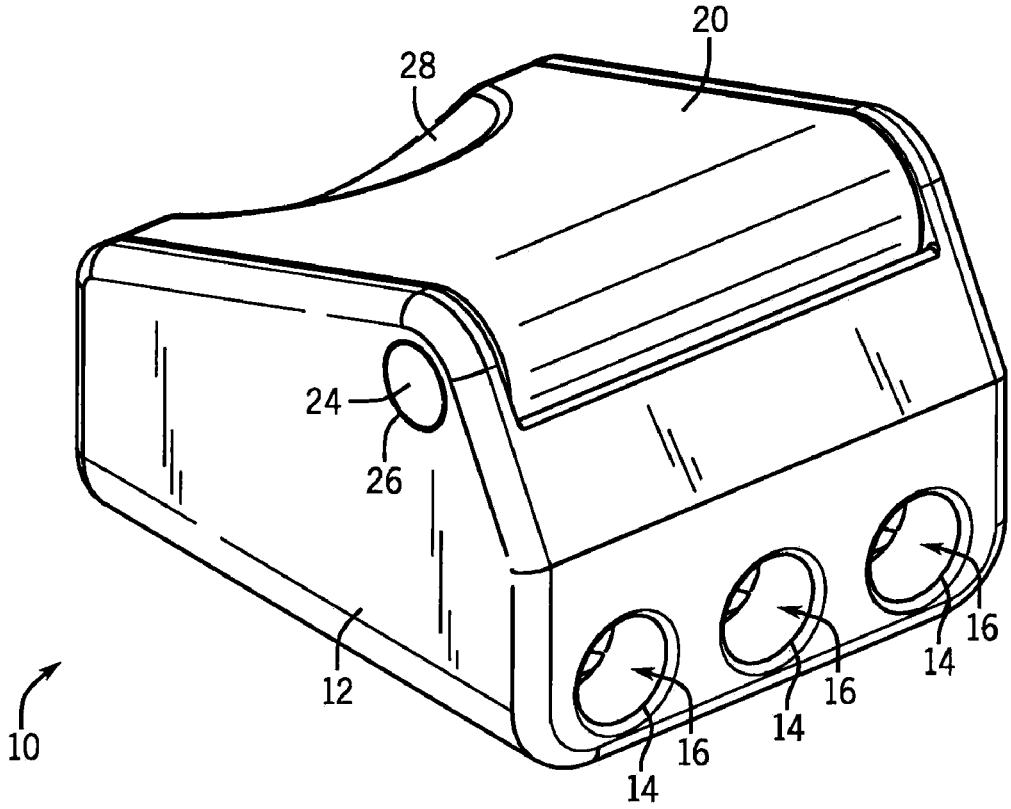
FIG. 5 is a perspective view of the insulation displacement connector in a closed position.
Figure 6:
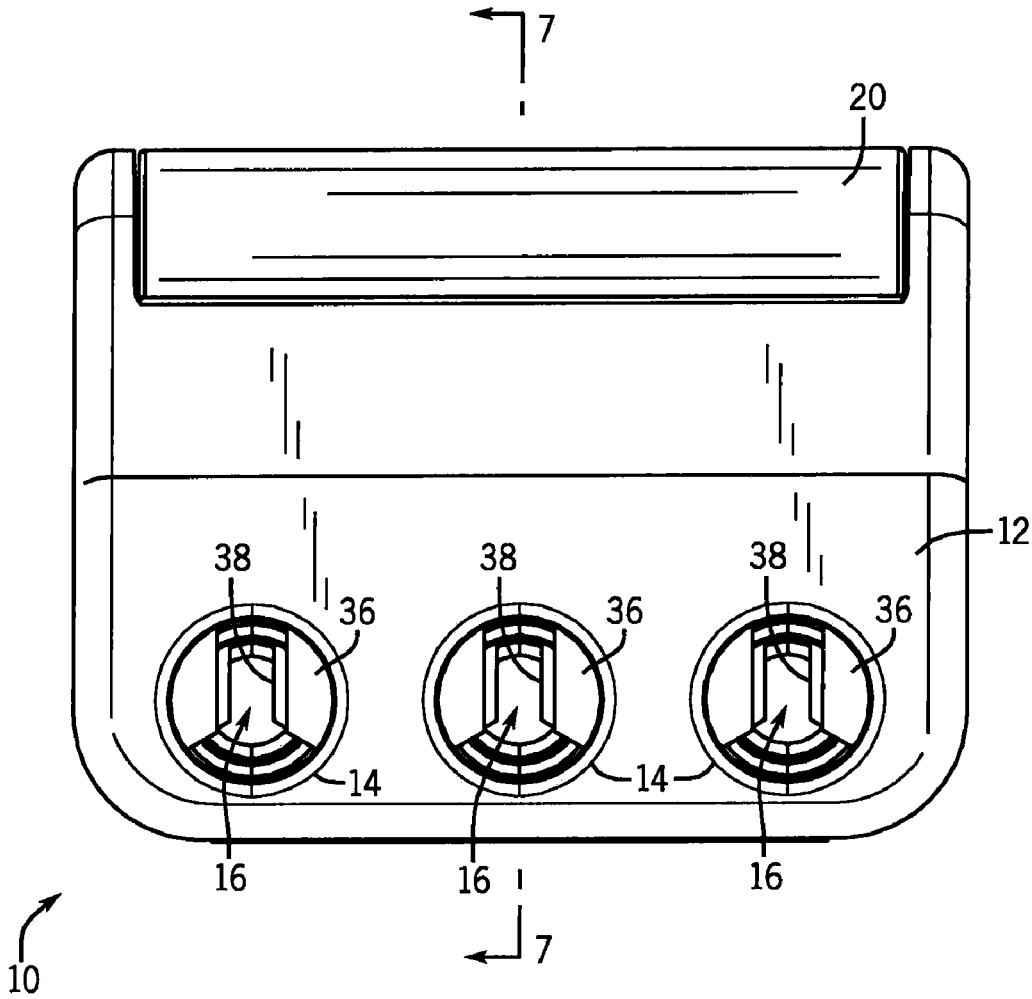
FIG. 6 is a front plan view of the insulation displacement connector of FIG. 5.
Figure 7:
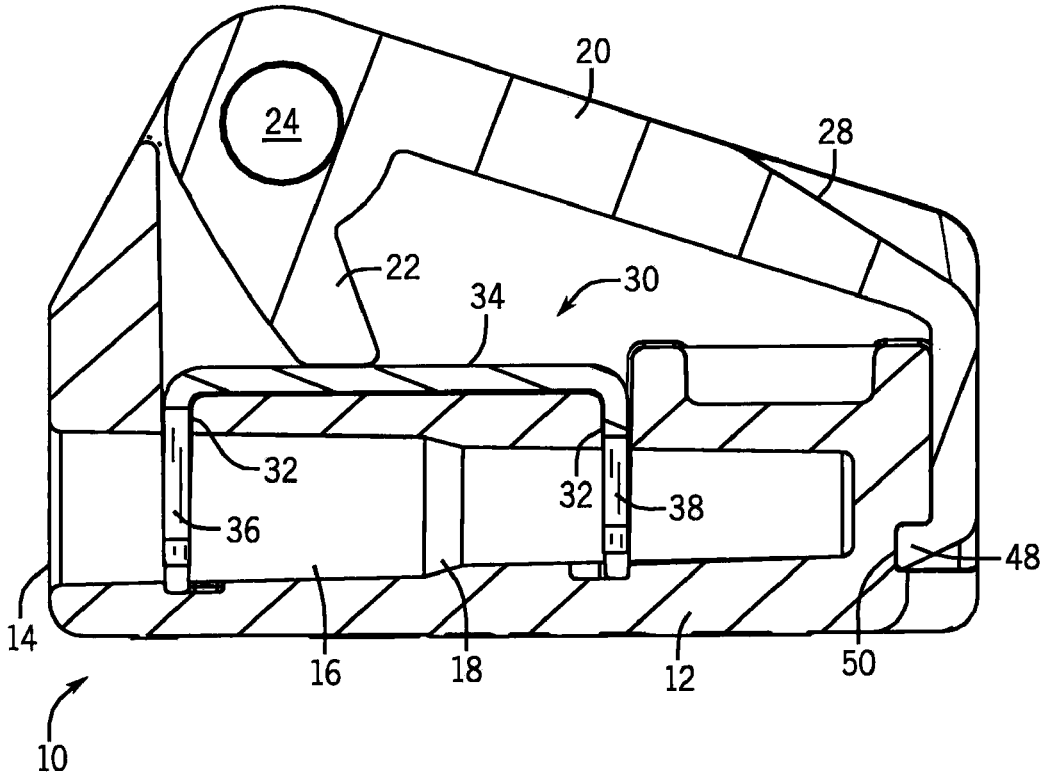
FIG. 7 is a cross-sectional side view of the insulation displacement connector along a line 7-7 of FIG. 6.

Referring now to FIGS. 5-7, the insulation displacement connector 10 is shown in the closed position after the handle 20 has been depressed. In the closed position, the cam portion 22 forces the blades of the metal insert 30 into the plurality of channels 16, such that any wires contained in the plurality of channels 16 may be pierced to form an electrical connection as will be described below.

Although the open position is shown as the position in which the handle 20 is up and the closed position is shown as the position in which the handle 20 is down, it should be appreciated that the open and closed positions are in fact determined by the orientation of the cam portion 22 and the position of the metal insert 30. When the cam portion 22 of the handle 20 contacts the surface of the body 34 of the metal insert 30 such that the cam portion 22 forces the blades of the metal insert 30 into the plurality of channels 16, then the handle 20 can be said to be in a closed position. However, when the metal insert 30 is able to move into and out of the plurality of channels 16 because the cam portion 22 does not restrict the body 34 of the metal insert 30, then the insulation displacement connector 10 is in the open position. However, the geometry of the handle 20 (i.e., the orientation of the cam portion 22 of the handle 20 relative to the lever portion of handle 20) may be such that it is differently located from the housing 12 in the open and closed positions.

Further, the handle 20 may have a locking portion 48 and the housing 12 may have a locking portion 50, such that when the handle 20 is moved to a closed position that is proximate the housing 12, then the locking portion 48 of the handle 20 interlocks with the locking portion 50 of the housing 12. In this way, the handle 20 may be locked such that the cam portion 22 will not freely rotate and allow the blades to disengage from the wires, thus breaking the electrical connection.

It should be appreciated that an upward force on the locking portion 48 of the handle 20 can cause the locking portions 48 and 50 of the handle 20 and the housing 12 to disengage from one another such that the handle 20 might be lifted back up.

Referring now to FIG. 6, a view down the plurality of channels 16 is shown when the cam portion 22 has forced the metal insert 30 into the plurality of channels. The first row of blades 36, closer to the plurality of openings 14, and the second row of blades 38, further from the plurality of openings 14, can be seen. As mentioned earlier, and can be clearly seen from this view, the gap 42 between the first row of blades 36 is less than the gap 46 between the second row of blades 38.

When the blades of the metal insert 30 enter the plurality of channels 16, then the blades may pierce the insulation coating any wires contained in the plurality of channels 16 to contact the metallic core of the wires. In particular, when the blades of the metal insert 30 enter the plurality of channels 16, the blades descend on opposite sides of the channel, such that the gap between the blades extends along a plane perpendicular to a direction of wire insertion and the gaps between each of the pairs of blades extends across the channel in a direction perpendicular to the direction of wire insertion.

Referring now to FIGS. 8-12, the general operation of the insulation displacement connector 10 is shown with respect to various gage wires.

Figure 8:
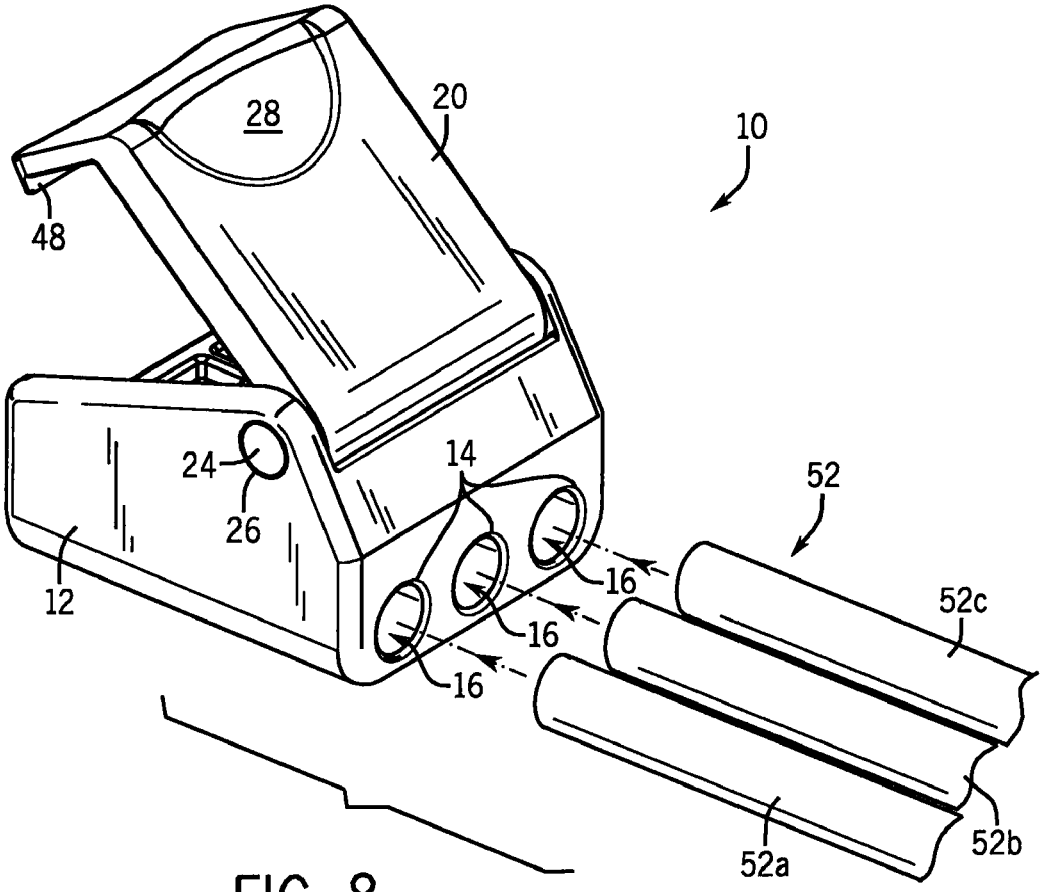
FIG. 8 is a perspective view of the insulation displacement connector in the open position with a plurality of wires having different gages being received therein.

As shown in FIG. 8, a plurality of wires 52 may be inserted into the plurality of openings 14 of the insulation displacement connector 10. Notably, the plurality of wires 52 includes wires of various gages and diameters. The plurality of wires include a wire 52*a*, a wire 52*b*, and a wire 52*c*. The diameter of the wire 52*a* is greater than the diameter of the wire 52*b*, which is greater that the diameter of the wire 52*c*.

Figure 9:
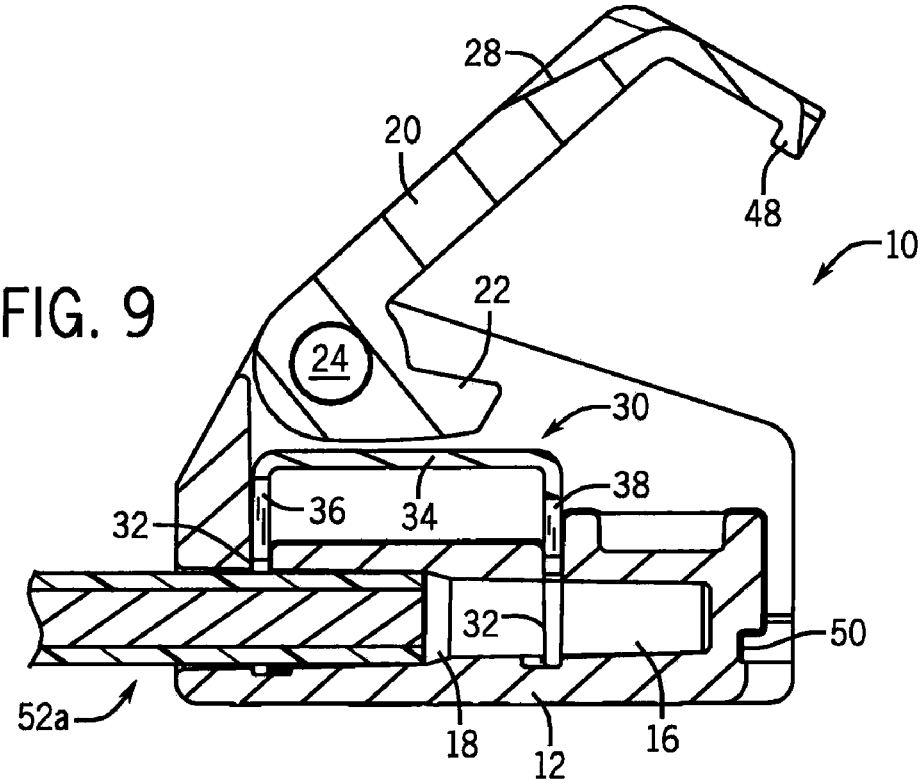
FIG. 9 is a cross-sectional side view of the insulation displacement connector with a larger diameter wire received therein and with the insulation displacement connector in an open position.
Figure 11:
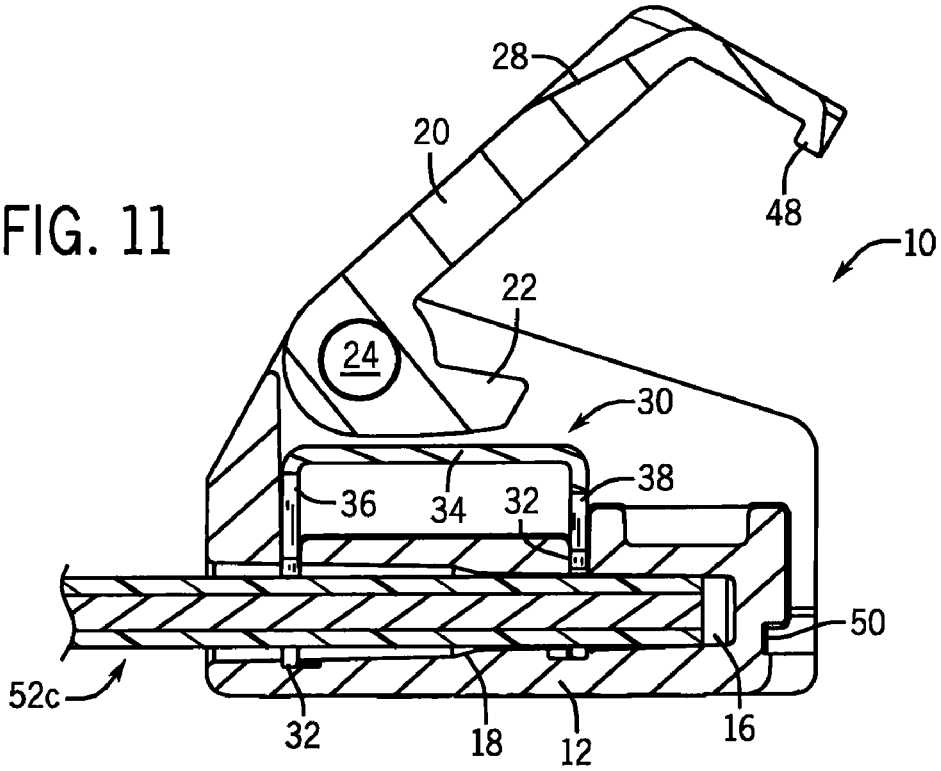
FIG. 11 is a cross-sectional side view of the insulation displacement connector with a smaller diameter wire received therein and with the insulation displacement connector in an open position.

As can be seen in FIGS. 9 and 11, the depth of insertion of the wires is limited by the reduction in effective diameter of the plurality of channels 16. As shown in FIG. 9, the wire 52*a* having the largest diameter is prevented from full insertion into the channel by the taper of the channel and, more specifically, the step 18 of the channel. However, the wires could also be restricted by a portion of the channel having a more gradual taper or any other reduction of effective diameter of the channel, instead of the step 18. In contrast, the wire 52*c* having the smallest diameter, as shown in FIG. 11, can be inserted more deeply into the channel.

The plurality of channels 16 reduce in effective diameter between the first row of blades 36 and the second row of blades 38 to determine the insertion depth of different diameter wires. If a plurality of wires 52 including relatively larger diameter wires and relatively smaller diameter wires is inserted into the plurality of channels 16, then reduction in effective diameter of the plurality of channels 16 restricts the insertion depth of each of the plurality of wires 52 having a relatively larger diameter so that they do not extend to the second row of blades 38. Likewise, the plurality of channels 16 permit each of the plurality of wires 52 having a relatively smaller diameter to reach the second row of blades 38. When the metal insert 30 is forced into the plurality of channels 16 to pierce an insulation covering of each of the plurality of wires 52, electrical contact is made between the first row of blades 36 and the relatively larger diameter wires and electrical contact is made between the second row of blades 38 and the relatively smaller diameter wires.

It is contemplated that the portion of the channels proximate the openings may be designed to receive 12-14 AWG wire and that the portion of the channels further from the openings (i.e., deeper in the channel) may be designed to receive 16-18 AWG wire. However, the channels may be designed to accommodate wires of other gages.

Figure 10:
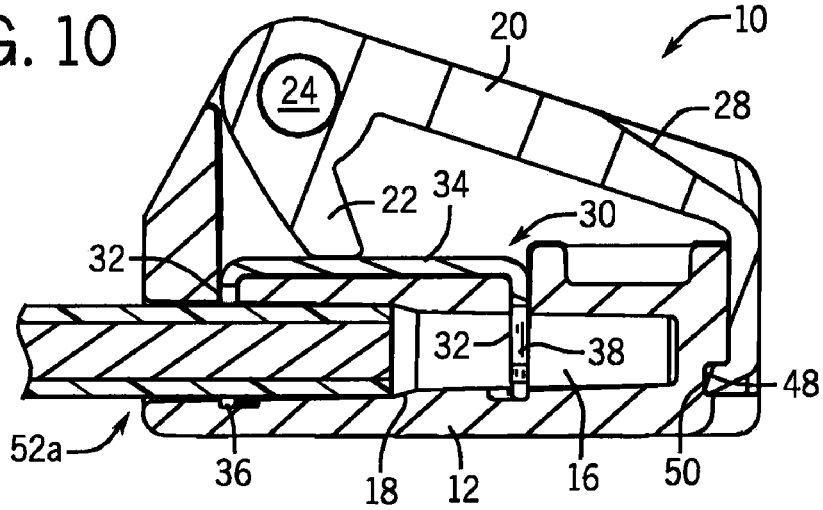
FIG. 10 is a cross-sectional side view of the insulation displacement connector with a larger diameter wire received therein and with the insulation displacement connector in a closed position.
Figure 12:
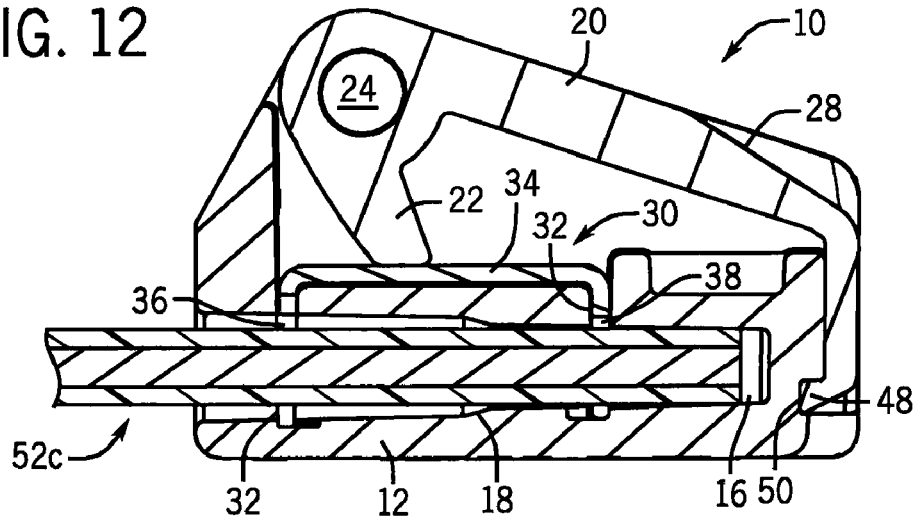
FIG. 12 is a cross-sectional side view of the insulation displacement connector with a smaller diameter wire received therein and with the insulation displacement connector in a closed position.

Once the plurality of wires 52 are received in the plurality of openings 14, the handle 20 may be moved from the open position (as shown in FIGS. 9 and 11) to the closed position (as shown in FIGS. 10 and 12) to form an electrical connection between the plurality of wires 52 contained in each of the plurality of channels 16. The electrical connection is formed when the blades of the metal insert 30 are forced through the insulation of each of the wires to contact the metallic core contained therein. In one form, the blades of the pair of blades have inner edges that face the gap such that when the metal insert 30 is downwardly inserted in the plurality of channels 16 to pierce a wire, the pair of blades of the metal insert 30 cut through an insulation covering the wire and the inner edges bite into the sides of a metallic core of the wire to form an electrical and mechanical connection therewith.

Because the metal insert 30 is substantially surrounded by the housing 12 and the handle 20 in the closed position which can both be made on a non-conductive material, the metal insert 30 can conduct a current between the plurality of wires 52 while being electrically isolated from its surroundings.

Figure 13:
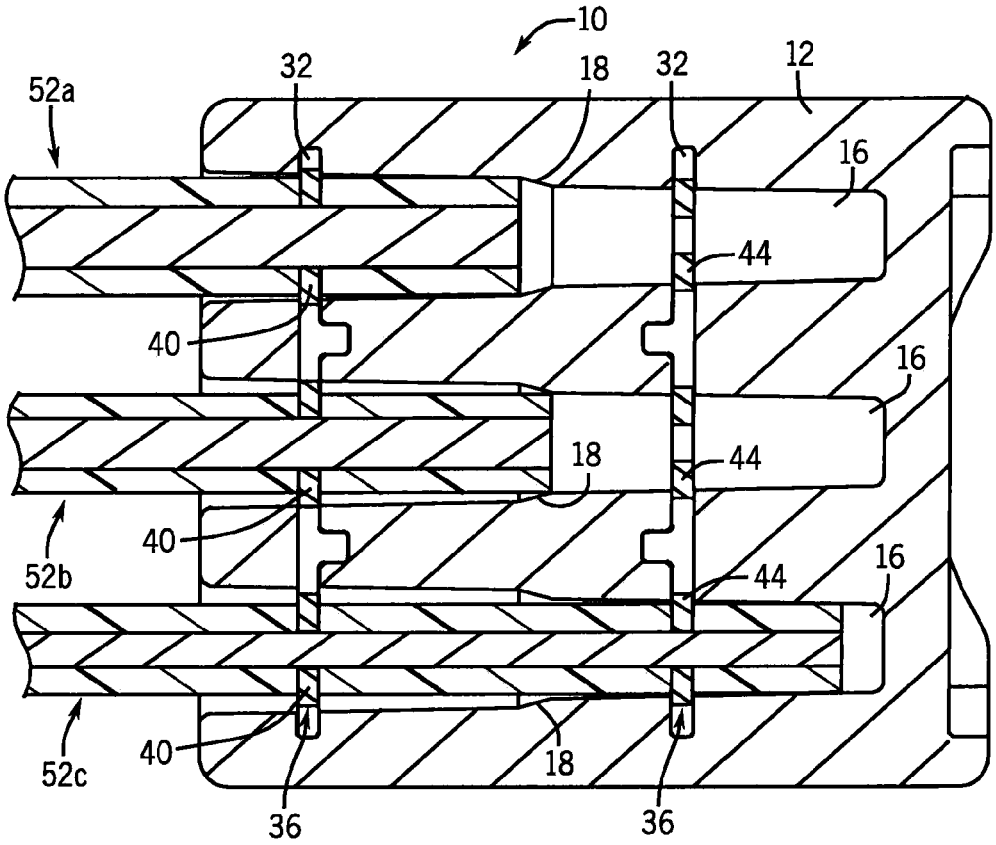
FIG. 13 is a cross-sectional top view of the insulation displacement connector of FIG. 8 in a closed position after having received the plurality of wires.

As can be seen in FIGS. 10, 12, and 13, the wire 52*a* with the largest diameter is engaged only by the first row of blades 36 (having the larger gap 42 between the pairs of blades) while the wire 52*c* with the smallest diameter is engaged by both the second row of blades 38 (having the smaller gap 46 between the pairs of blades) as well as the first row of blades 36. In each case, at least one of the first row of blades 36 and the second row of blades 38 contacts the metallic core of the wire to form an electrical connection between the metal insert 30 and the wire, and ultimately between the plurality of wires 52 inserted into each of the plurality of channels 16.

When the restrictive insertion is coupled with the fact that the rows of blades of the metal insert 30 have various size gaps therebetween, it is possible to ensure that each of the plurality of wires 52 have their insulation pierced and the metallic core contacted by a set of blades with an appropriately-sized gap therebetween as seen in FIG. 13. The combination of the reduction in effective diameter of the channels and the decreasing gap sizes from the first row of blades 36 to the second row of blades 38 is advantageous in that it minimizes the force required to force the blades into or around the wires to form the electrical connection while still allowing for the wire connector to be used to connect various gages of wires. Ideally, the force will remain sufficiently small that handle 20 can be finger-operated without much difficulty to connect the wires.

If only one set of blades were present, then the insulation displacement connector 10 would not be well-suited to connect wires of substantially different diameters. If only one set of blades were available, then the blades would need to have a gap therebetween that was sufficiently small to ensure contact with the metallic core of the smallest wire upon piercing of the insulation. However, having a small gap between the blades to accommodate for small diameter wires creates force insertion problems when contacting wires having a large diameter metallic core. In order to force a set of blades with a small gap into or around the metallic wire core with a large diameter, at least one of the blades and wire must be deformed. Inducing this deformation requires that a great amount of force be applied to the blade. This makes it difficult to finger operate the connector or necessitates the use of a tool to apply a sufficient insertion force. Having two sets of blades, arranged in the manner described above, means that blades with a gap similar to the diameter of the metallic core can pierce the wire, thus reducing the force required to bite down on the wires to form the connection.

However, merely having two sets of blades with various-sized gaps between the blades will not ensure that the set of blades with the appropriate gap therebetween will pierce the blades. For example, if not for the reduction in effective diameter of the channels, then a large diameter wire could be deeply inserted into the channel to the back row of blades with the smaller blade gap. If this were to happen, then a large insertion force would be required to have the rear set of blades clamp down on the wire. The reduction in effective diameter of the channel restricts the insertion depth of the larger diameter wires to ensure that only a set of blades having an appropriate gap clamp down on the wire in the channel.

Further, the placement of the step 18 between the points of intersection between the track 32 and the plurality of channels 16 will further selectively restrict the insertion depth of the wires in the plurality of channels 16. As the thickness of the insulation surrounding the metallic core of a wire may vary among different types of wires, the diameter of the wire is not always a sufficient predictor of the metallic core contained therein. However, it is fairly reasonable to expect that within a certain range of diameters for the insulation that a corresponding range of diameters for the metallic core is likely. Thus, the step 18 can be used to ensure that a wire with a relatively thin layer of insulation, but with a large diameter metallic core does not get deeply inserted into the smaller diameter portions of the plurality of channels 16.

As can be seen best in FIG. 13, the first row of blades 36 may only make electrical contact with the relatively larger diameter wires, by contacting the metallic core of the larger diameter wires, while the second row of blades 38 may only make electrical contact with the relatively smaller diameter wires. Although not required, it is possible that both the first row of blades 36 and the second row of blades 38 may make electrical contact with the smaller diameter wire.

Thus, the present invention provides an insulation displacement connector that is suitable for the tool-less connection of wires of various gages. The combination of channels having a reduction in effective diameter and blades having various gaps restricts the insertion of the wires such that an appropriately-sized pair of blades can pierce the insulation to contact the metallic core of each wire. Because of this configuration, the wire connector does not require excessive force to bite down on the wires. Because a large force is not required, the insulation displacement connector can be finger operated and no separate tool is necessary.

Preferred embodiments of the invention have been described in considerable detail. Many modifications and variations to the preferred embodiments described will be apparent to a person of ordinary skill in the art. Therefore, the invention should not be limited to the embodiments described.

I claim:

1. An insulation displacement connector comprising:

a housing defining at least one channel for receiving at least one wire from at least one point of wire insertion, the housing further defining a track that intersects the at least one channel;

a metal insert having a body portion with at least one blade extending therefrom, the metal insert being located and slideably moveable within the track such that a portion of the at least one blade can move into and out of the at least one channel of the housing; and a handle having a cam portion, the handle being rotatable relative to the housing about an axis that runs through the cam portion of the handle, the cam portion selectively contacting the body portion of the metal insert as the handle is rotated about the axis;

wherein the insulation displacement connector has an open position in which the at least one wire can be received by the at least one channel and a closed position in which the cam portion of the handle forces the at least one blade of the metal insert into the at least one channel to pierce the insulation of any wire contained therein.

2. An insulation displacement connector of claim 1, wherein the handle further includes a locking portion and the housing further includes a locking portion such that the locking portion of the handle locks to the locking portion of the housing when the handle is moved into the closed position.

3. An insulation displacement connector of claim 1, wherein the at least one channel for receiving at least one wire reduces in effective diameter inwardly as it extends away from the at least one point of wire insertion.

4. An insulation displacement connector of claim 3, wherein the at least one channel for receiving at least one wire is tapered.

5. An insulation displacement connector of claim 3, wherein the metal insert has at least a pair of blades on each of opposite sides of the body portion, each pair of blades having a corresponding gap therebetween and each pair of blades having a portion that is slideably moveable into and out of the at least one channel.

6. An insulation displacement connector of claim 5, wherein the gap between the pair of blades on one side of the body portion of the metal insert is greater than the gap between the pair of blades on the other side of the body portion of the metal insert.

7. An insulation displacement connector of claim 6, wherein the pair of blades with a larger gap between the pair of blades intersects the at least one channel at a location closer to the point of wire insertion than a location at which the pair of blades with a smaller gap between the pair of blades intersects the at least one channel.

8. An insulation displacement connector of claim 7, wherein the at least one channel further comprises a step having an increased rate of inward taper as the at least one channel extends away from the at least one point of wire insertion, the step being located between an intersection of the track and the at least one channel proximate the pair of blades having the larger gap therebetween and an other intersection of the track and the at least one channel proximate the pair of blades having the smaller gap therebetween.

9. An insulation displacement connector of claim 6, wherein each of the pair of blades have a pair of sharpened edges that extend towards the body of the metal insert as the pair of sharpened edges extend towards the gap between each of the pair of blades.

10. An insulation displacement connector of claim 1, wherein at least a portion of the track is oriented at an acute angle to the at least one channel for receiving at least one wire along a direction of wire insertion.

11. An insulation displacement connector of claim 1, wherein the track is oriented orthogonally to a direction of wire insertion.

12. An insulation displacement connector of claim 1, wherein the at least one channel includes two channels, such that when a pair of wires are inserted into the two channels and the insulation displacement connector is moved to the closed position, the metal insert pierces an insulation of the pair of wires to form an electrical connection between the pair of wires.

13. An insulation displacement connector of claim 1, wherein the insulation displacement connector is configured to be moved from the open position to the closed position without a tool.

14. An insulation displacement connector comprising:

a plurality of channels for receiving a plurality of wires along a direction of wire insertion, each of the channels extending from a corresponding opening for insertion of one of the wires;

a metal insert slideably moveable in a track and having a first row of blades and second row of blades that selectively intersect the channels, the first row of blades and the second row of blades each having a plurality of pairs of blades having a gap between the blades of each pair such that the gap between the blades of each pair of blades in the first row is greater than the gap between the blades of each pair of blades in the second row, wherein the pairs of blades of the first row of blades intersect corresponding channels at an intersection proximal the corresponding opening of each of the channels and the pairs of blades of the second row of blades intersect corresponding channels at an intersection distal the corresponding opening of each of the channels, so that when each of the pair of blades intersects the channel, the gap extends laterally across the corresponding channel relative to the direction of wire insertion; and wherein each of the channels reduce in effective diameter between the first row of blades and the second row of blades so that, if a plurality of wires including relatively larger diameter wires and relatively smaller diameter wires is inserted into the channels, the channels restrict an insertion depth of the relatively larger diameter wires so that they do not reach the second row of blades and the channels permit the relatively smaller diameter wires to reach the second row of blades, wherein when the metal insert is forced into the channels so as to pierce an insulation covering of each of the wires, electrical contact is made between the first row of blades and the relatively larger diameter wires and electrical contact is made between the second row of blades and the relatively smaller diameter wires.

15. An insulation displacement connector of claim 14, wherein the plurality of channels are parallel to one another.

16. An insulation displacement connector of claim 14, wherein the plurality of channels taper between the first and second rows of blades.

17. An insulation displacement connector of claim 16, wherein each of the plurality of channels includes a step down in effective diameter as channel extends away from the corresponding opening, the step being located between the first row of blades and the second row of blades.

18. An insulation displacement connector of claim 14, wherein the first row of blades only makes electrical contact with the relatively larger diameter wires and the second row of blades only makes electrical contact with the relatively smaller diameter wires.

19. An insulation displacement connector of claim 14, wherein the blades of the pair of blades have inner edges that face the gap such that when the metal insert is downwardly inserted in the plurality of channels to pierce a wire, the pair of blades of the metal insert cut through an insulation covering the wire and the inner edges to contact the sides of a metallic core of the wire to form an electrical connection.

* * * * *